US009533849B2

(12) United States Patent
Kasaishi et al.

(10) Patent No.: US 9,533,849 B2
(45) Date of Patent: Jan. 3, 2017

(54) SHEET CONVEYANCE APPARATUS AND IMAGE FORMING APPARATUS

(71) Applicant: CANON KABUSHIKI KAISHA, Tokyo (JP)

(72) Inventors: Takugo Kasaishi, Tokyo (JP); Daisuke Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/940,401

(22) Filed: Nov. 13, 2015

(65) Prior Publication Data

US 2016/0137444 A1 May 19, 2016

(30) Foreign Application Priority Data

Nov. 19, 2014 (JP) ..... 2014-234446

(51) Int. Cl.

| | |
|---|---|
| ***B65H 3/44*** | (2006.01) |
| ***B65H 5/36*** | (2006.01) |
| ***G03G 15/00*** | (2006.01) |
| ***B65H 1/26*** | (2006.01) |
| ***B65H 5/06*** | (2006.01) |
| ***B65H 5/26*** | (2006.01) |
| *B65H 1/02* | (2006.01) |

(52) U.S. Cl.

CPC ..... *B65H 5/36* (2013.01); *B65H 1/266* (2013.01); *B65H 5/06* (2013.01); *B65H 5/26* (2013.01); *G03G 15/6529* (2013.01); *B65H 1/027* (2013.01); *B65H 2402/442* (2013.01)

(58) Field of Classification Search

CPC ..... B65H 1/027; B65H 1/266

See application file for complete search history.

(56) References Cited

U.S. PATENT DOCUMENTS

| | | | | |
|---|---|---|---|---|
| 5,016,864 | A * | 5/1991 | Nonami | B65H 3/02 271/38 |
| 6,994,341 | B2 | 2/2006 | Aoki et al. | |
| 8,960,664 | B2 | 2/2015 | Maeda et al. | |
| 9,024,984 | B2 | 5/2015 | Akatsuka et al. | |
| 9,056,745 | B2 | 6/2015 | Harada et al. | |
| 2011/0311269 | A1* | 12/2011 | Murooka | G03G 15/6502 399/110 |
| 2013/0228967 | A1* | 9/2013 | Maeda | B65H 1/00 271/264 |
| 2015/0061219 | A1 | 3/2015 | Murakami et al. | |
| 2015/0115526 | A1 | 4/2015 | Harada et al. | |

FOREIGN PATENT DOCUMENTS

JP 2013-180864 A 9/2013

* cited by examiner

*Primary Examiner* — Howard Sanders

(74) *Attorney, Agent, or Firm* — Fitzpatrick, Cella, Harper & Scinto

(57) ABSTRACT

A sheet conveyance apparatus includes an apparatus body, a sheet stacking portion including an engagement portion, provided to be insertable to/removable from the apparatus body and capable of having sheets stacked thereon, and a conveyance guide portion provided to be insertable to/removable from the apparatus body and constituting a sheet conveyance path through which a sheet passes in a state where the conveyance guide portion is mounted to a mounted position in the apparatus body. The conveyance guide portion has an engaged portion that is pressed by the engagement portion accompanying an operation where the sheet stacking portion is inserted to the apparatus body, and moves the conveyance guide portion to the mounted position.

10 Claims, 10 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus for conveying stacked sheets one by one, and an image forming apparatus adopting the same. In further detail, the present invention relates to a sheet conveyance apparatus having a conveyance guide portion disposed at an upper area of the sheet stacking portion for feeding sheets manually, and an image forming apparatus adopting the same.

Description of the Related Art

In the prior art, electro-photographic image forming apparatuses are used widely as copying machines, printers, plotters, facsimiles, and multifunction printers having these multiple functions. The image forming apparatuses such as the one disclosed in Japanese Patent Application Laid-Open Publication No. 2013-180864 equipped with a sheet stacking portion capable of having multiple sheets stacked thereon and a conveyance guide portion for guiding manually-fed sheets are becoming popular. According to this type of image forming apparatus, the conveyance guide portion is inserted to the apparatus body in a removable manner to facilitate handling of jammed sheets.

According to such image forming apparatus, when a user wishes to form images on regular-sized sheets used frequently, the user stacks the sheets on the sheet stacking portion, and the sheets are fed one by one from the uppermost sheet via the sheet feeding portion. When the user wishes to form images on a regular-sized sheet that is not used frequently, such as a cardboard sheet, or on an irregular sheet such as a long paper sheet having an irregular size, the user feeds the sheet manually to the conveyance guide portion.

However, according to the image forming apparatus disclosed in the above-described patent document, when the user feeds a sheet manually to the apparatus, there may be a case where the sheet is fed to the apparatus even when the conveyance guide portion is displaced from the correct position with respect to the apparatus body. In that case, there is a drawback that depressurization may occur between a roller provided to the conveyance guide portion and a roller provided to the apparatus body, and may be causing slipping or skewing of the sheets.

SUMMARY OF THE INVENTION

According to one aspect of the invention, a sheet conveyance apparatus, comprising: an apparatus body; a sheet stacking portion on which sheets are stacked, the sheet stacking portion including an engagement portion and provided to be insertable to/removable from the apparatus body; and a conveyance guide portion provided to be insertable to/removable from the apparatus body and constituting a sheet conveyance path through which a sheet passes in a state where the conveyance guide portion is mounted to a mounted position in the apparatus body, the conveyance guide portion including an engaged portion that is pressed by the engagement portion accompanying an operation where the sheet stacking portion is inserted to the apparatus body, and moves the conveyance guide portion to the mounted position.

Further features of the present invention will become apparent from the following description of exemplary embodiments with reference to the attached drawings.

DESCRIPTION OF THE EMBODIMENTS

Now, a preferred embodiment of the present invention will be described in detail with reference to FIGS. 1 through 10. In the present embodiment, a tandem-type full color printer is illustrated as an example of an image forming apparatus. However, the present invention is not restricted to the tandem-type image forming apparatus, and can adopt other types of image forming apparatuses, or can be a monochrome apparatus instead of a full color apparatus.

Figure 1:
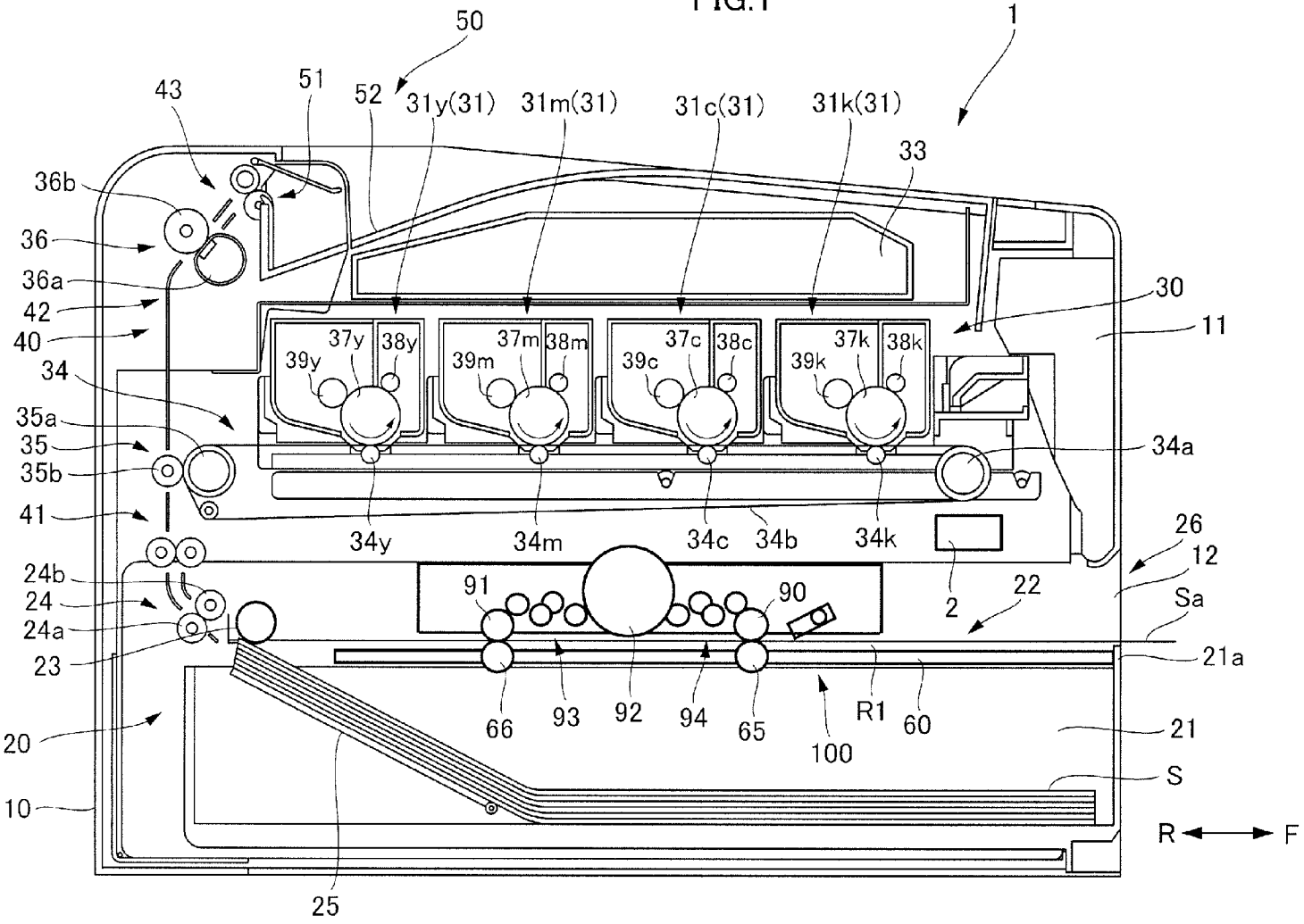
FIG. 1 is a cross-sectional schematic diagram of an image forming apparatus according to a preferred embodiment.
Figure 2:
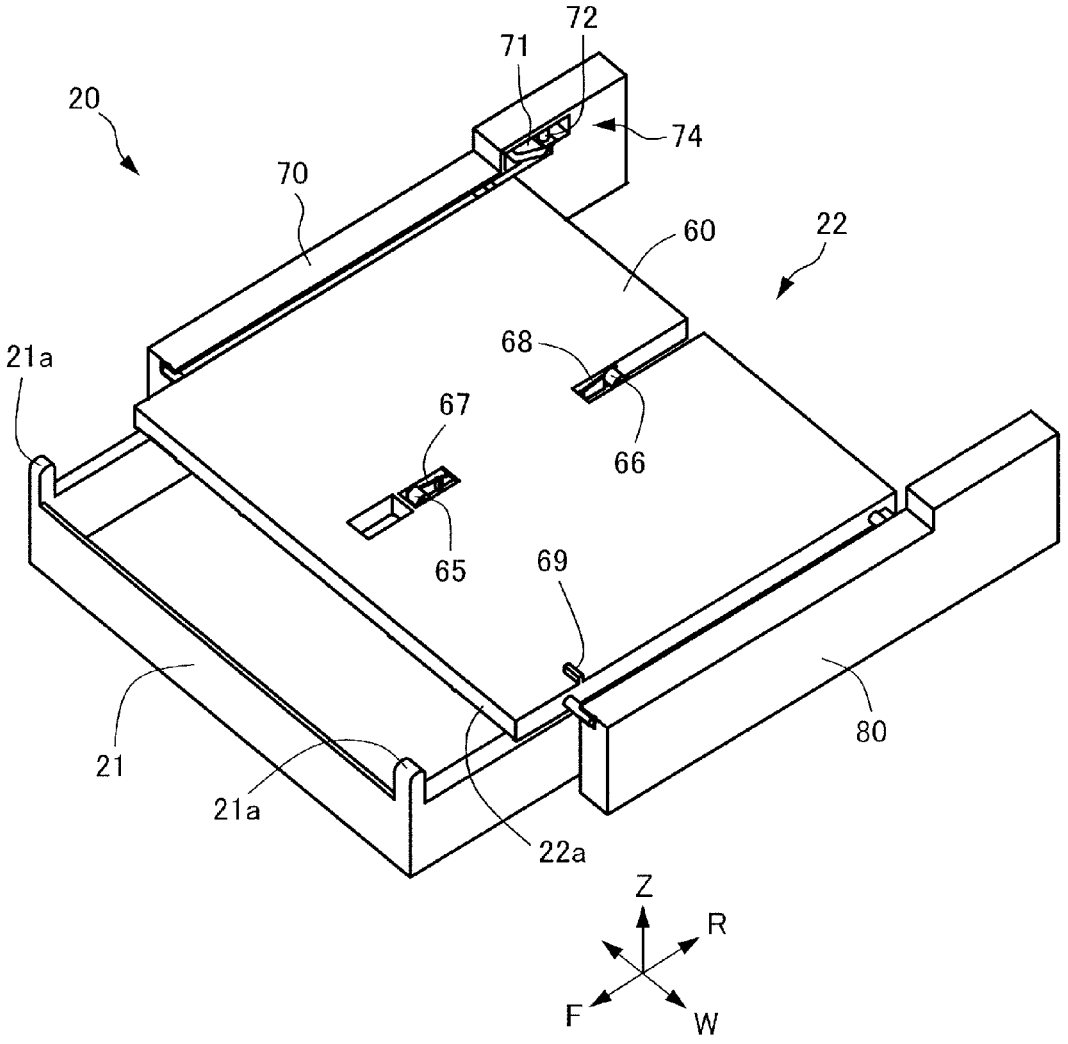
FIG. 2 is a schematic diagram of a state where a sheet cassette of a sheet feeding portion is inserted to the image forming apparatus according to the preferred embodiment.
Figure 3:
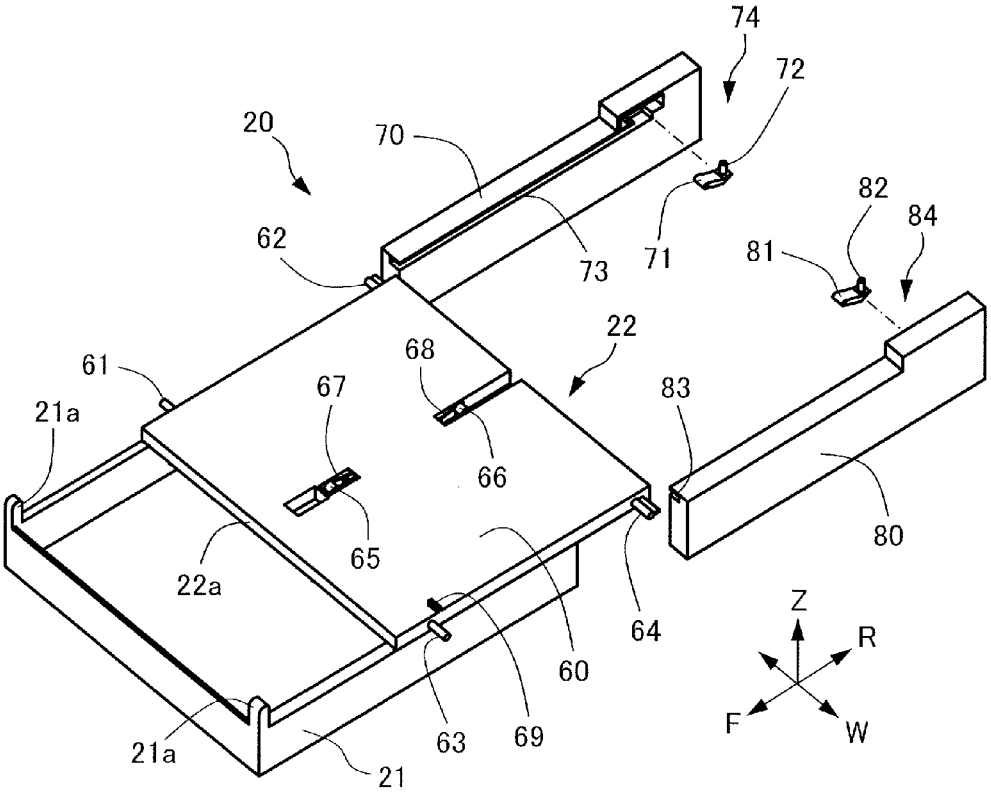
FIG. 3 is a schematic diagram of a state where the sheet cassette of the sheet feeding portion is removed from the image forming apparatus according to the preferred embodiment.

As shown in FIG. 1, an image forming apparatus 1 is equipped with an image forming apparatus body (hereinafter referred to as apparatus body) 10. The apparatus body 10 is equipped with a sheet feeding portion (sheet conveyance apparatus) 20, an image forming portion 30, a sheet conveyance portion 40, a sheet discharging portion 50, a sheet presence detecting portion 100, and a control unit 2. That is, the image forming apparatus 1 is equipped with the image forming portion 30 for forming images, and the sheet feeding portion 20 for feeding sheets S to the image forming portion 30. The sheet S is a recording medium on which a toner image is formed, and actual examples of the sheet S may include regular paper, synthetic resin sheets as substitute for regular paper, cardboard, OHP sheets, and so on. The apparatus body 10 is also equipped with a door 11. In the present embodiment, the side on which the door 11 is formed is referred to as a front side of the image forming apparatus 1. Further, in the drawing, the front side direction is referred to as forward F, and the direction opposite therefrom is referred to as rearward R.

The sheet feeding portion 20 is arranged at the lower area of the apparatus body 10 and feeds the sheet S to the image forming portion 30. The sheet feeding portion 20 is equipped with a sheet cassette (sheet stacking portion) 21 capable of having sheets S stacked therein, a conveyance guide portion 22, a feeding roller 23, and a separating portion 24. The sheet cassette 21 is disposed in an insertable and removable manner in frontward-rearward directions at the front side of the apparatus body 10. The sheet cassette 21 is equipped with an intermediate plate 25 supporting the stacked sheet S and pressing the stored sheet S against the feeding roller 23. The separating portion 24 is equipped with a conveyance roller 24*a* and a separating roller 24*b*. The conveyance roller 24*a* and the separating roller 24*b* are pressed against one another to separate the sheet S.

A manual feed port 12 is formed between the conveyance guide portion 22 and the door 11. A manual sheet feeding portion 26 using a sheet conveyance path R1 is disposed on a rearward R side of the manual feed port 12. On the sheet conveyance path R1 are provided drive rollers 90 and 91 disposed on the apparatus body 10, and driven rollers 65 and 66 pressed against the respective drive rollers 90 and 91 and disposed on the conveyance guide portion 22. A manually-fed sheet Sa set through the manual feed port 12 to the conveyance guide portion 22 is conveyed via the drive rollers 90 and 91 and reaches the separating portion 24. That is, the conveyance guide portion 22 conveys the manually-fed sheet Sa from the manual sheet feeding portion 26 through the sheet conveyance path R1. The drive rollers 90 and 91 are rotated via gear trains 93 and 94 by a drive motor 92 as driving source. The drive rollers 90 and 91, the drive motor 92 and the respective gear trains 93 and 94 are all supported on a supporting portion 95 disposed above the conveyance guide portion 22. The details of the sheet feeding portion 20 will be described later.

The image forming portion 30 is equipped with an image forming unit 31, a laser scanner 33, an intermediate transfer unit 34, a secondary transfer portion 35 and a fixing unit 36, and forms images.

The image forming unit 31 is equipped with four image forming units 31*y*, 31*m*, 31*c* and 31*k* for forming four-color toner images, which are yellow (y), magenta (m), cyan (c) and black (k). For example, the image forming unit 31*y* is equipped with a photosensitive drum 37*y* for forming toner images, a charging roller 38*y*, a developing sleeve 39*y*, a drum cleaning blade not shown, a toner, and so on. Further, the toner is stored in a container of the image forming unit 31*y*. As for the other image forming units 31*m*, 31*c* and 31*k*, they are configured similarly as the image forming unit 31*y* except for the difference in toner colors, so that the detailed descriptions thereof are omitted.

The laser scanner 33 exposes the surface of the photosensitive drums 37*y*, 37*m*, 37*c* and 37*k*, and forms an electrostatic latent image on the surface.

The intermediate transfer unit 34 is equipped with a plurality of rollers, such as a drive roller 34*a* and primary transfer rollers 34*y*, 34*m*, 34*c* and 34*k*, and an intermediate transfer belt 34*b* wound around these rollers. The primary transfer rollers 34*y*, 34*m*, 34*c* and 34*k* are respectively arranged to face the photosensitive drums 37*y*, 37*m*, 37*c* and 37*k*, and are in contact with the intermediate transfer belt 34*b*. By applying a transfer bias having positive polarity from the primary transfer rollers 34*y*, 34*m*, 34*c* and 34*k* to the intermediate transfer belt 34*b*, the respective toner images having negative polarities on the photosensitive drums 37*y*, 37*m*, 37*c* and 37*k* are respectively sequentially transferred to the intermediate transfer belt 34*b* in multiple layers. Thereby, a full-color image is formed on the intermediate transfer belt 34*b*.

The secondary transfer portion 35 is equipped with a secondary transfer inner roller 35*a* and a secondary transfer outer roller 35*b*. A full-color image formed on the intermediate transfer belt 34*b* is transferred to the sheet S by applying a secondary transfer bias having positive polarity on the secondary transfer outer roller 35*b*. The secondary transfer inner roller 35*a* stretches the intermediate transfer belt 34*b* in an inner side of the intermediate transfer belt 34*b*, and the secondary transfer outer roller 35*b* is arranged at a position facing the secondary transfer inner roller 35*a* with the intermediate transfer belt 34*b* interposed therebetween.

The fixing unit 36 is equipped with a fixing roller 36*a* and a pressure roller 36*b*. A sheet S is nipped between and transferred by the fixing roller 36*a* and the pressure roller 36*b*, and the toner image transferred to the sheet S is heated, pressed, and fixed onto the sheet S.

The sheet conveyance portion 40 is equipped with a pre-secondary-transfer conveyance path 41, a pre-fixing conveyance path 42 and a discharge path 43 for conveying the sheet S fed from the sheet feeding portion 20 via the image forming portion 30 to the sheet discharge portion 50.

The sheet discharge portion 50 is equipped with a discharge roller pair 51 arranged on a downstream side of the discharge path 43, and a discharge tray 52 arranged on a downstream side of the discharge roller pair 51. The discharge roller pair 51 feeds the sheet S conveyed from the discharge path 43 via the nip portion, and discharges the sheet to the discharge tray 52 where the sheet is stacked.

The sheet presence detecting portion 100 is capable of detecting the presence of the manually-fed sheet Sa on the sheet conveyance path R1. The details of the sheet presence detecting portion 100 will be described later.

The control unit 2 is composed of a computer equipped with, for example, a CPU, a ROM storing programs for controlling respective portions, a RAM for temporarily storing data, and an input/output circuit (I/F) for inputting and outputting signals from/to an exterior. The CPU is a microprocessor carrying out the overall control of the image forming apparatus 1, and it is the main body of a system controller. The CPU is connected via the input/output circuit with the sheet feeding portion 20, the image forming portion 30, the sheet conveyance portion 40 and the sheet discharging portion 50, for communicating signals with the respective portions and controlling the operations thereof.

Next, we will describe an image forming operation according to the image forming apparatus 1 having the above-described configuration.

When the image forming operation is started, at first, photosensitive drums 37*y*, 37*m*, 37*c* and 37*k* are rotated and the surfaces of the drums are respectively charged by charging rollers 38*y*, 38*m*, 38*c* and 38*k*. Thereafter, laser beams are irradiated from the laser scanner 33 to the respective photosensitive drums 37*y*, 37*m*, 37*c* and 37*k* based on the image information, and electrostatic latent images are formed on the surfaces of the photosensitive drums 37*y*, 37*m*, 37*c* and 37*k*. By having toner adhere to the electrostatic latent images, the electrostatic latent images are developed and visualized as toner images. At this time, the amount of toner being developed is increased as a potential difference, that is the difference between an amount of exposure and bias applied to the developing sleeves 39*y*, 39*m*, 39*c* and 39*k*, is increased. The toner images made visible are transferred onto the intermediate transfer belt 34*b*.

On the other hand, in parallel with the above-described operation for forming toner images, the feeding roller 23 rotates, separating the uppermost sheet S in the sheet cassette 21 and feeding the sheet. Then, at a matched timing with the toner image on the intermediate transfer belt 34*b*, the sheet S is conveyed via the pre-secondary-transfer conveying path 41 to the secondary transfer portion 35. Further, the image is transferred from the intermediate transfer belt 34*b* to the sheet S, then the sheet S is conveyed to the fixing unit 36, where the unfixed toner image is heated, pressed and fixed onto the surface of the sheet S, and then the sheet S is discharged by the discharge roller pair 51 and stacked on the discharge tray 52.

Further, when performing a manual feeding operation of the sheet S, the user inserts the manually-fed sheet Sa through the manual feed port 12 to the conveyance guide portion 22 of the manual sheet feeding portion 26, and sends the sheet to the sheet conveyance path R1. The sheet conveyance path R1 for the manually-fed sheet is formed continuously from the manual feed port 12 to the separating portion 24. The manually-fed sheet Sa set through the manual feed port 12 to the conveyance guide portion 22 is conveyed via the drive rollers 90 and 91 and reaches the separating portion 24. Similar to the sheet S stacked on the sheet cassette 21, the manually-fed sheet Sa having reached the separating portion 24 has the color toner image transferred and fixed thereto, and then the sheet Sa is discharged onto the discharge tray 52.

Next, we will describe the sheet feeding portion 20 in the above-described image forming apparatus 1 in detail with reference to FIGS. 2, 3, and 4A through 4H.

The conveyance guide portion 22 of the sheet feeding portion 20 is disposed in an insertable and removable manner in frontward-rearward directions at the front side of the apparatus body 10, and constitutes a sheet conveyance path R1 through which the sheet S passes in a state where the conveyance guide portion 22 is mounted to a mounted position 22A of the apparatus body 10 (refer to FIG. 1). That is, the conveyance guide portion 22 is positioned at the mounted position 22A with respect to the apparatus body 10 during conveyance of the sheet S (refer to FIGS. 4G and 4H). In the present embodiment, the conveyance guide portion 22 is arranged above the sheet cassette 21.

The conveyance guide portion 22 has a guide plate 60, guide projections 61 through 64 projecting to the side directions from front and rear portions of both left and right sides of the guide plate 60, driven rollers 65 and 66 supported rotatably on the guide plate 60, biasing springs 67 and 68, and an engagement projection 69. The guide plate 60 defines the sheet conveyance path R1 at the upper surface thereof. The respective guide projections 61 through 64 are disposed to protrude to at least one of the width directions W orthogonal to the insertion and removal directions, and supported slidably in front-rear directions (insertion and removal directions) via support plates 70 and 80 described later. The biasing springs 67 and 68 are formed of torsion coil springs, and bias the respective driven rollers 65 and 66 upward. The driven rollers 65 and 66 are disposed to be pressed against the drive rollers 90 and 91 of the apparatus body 10 via biasing springs 67 and 68 when the conveyance guide portion 22 is positioned at the mounted position 22A. The engagement projection 69 can be engaged with a projection 113 on the sheet presence detecting portion 100 described later (refer to FIG. 8A).

In the sheet feeding portion 20, the conveyance guide portion 22 is moved to the mounted position 22A along with the operation of inserting the sheet cassette 21 to the apparatus body 10. According to the present embodiment, the sheet feeding portion 20 is equipped with an interlocking portion for having the conveyance guide portion 22 positioned at the mounted position 22A along with the operation of inserting the sheet cassette 21 to the apparatus body 10. The interlocking portion has a projection (engagement portion) 21*a* provided on the sheet cassette 21 and a front end portion (engaged portion) 22*a* provided on the conveyance guide portion 22. The projection 21*a* is formed to protrude upward at the front end portion in the direction in which the sheet cassette 21 is inserted to and removed from the apparatus body 10, and is capable of being in contact with a front end portion in the removal direction (downstream end in the removal direction) 22*a* of the conveyance guide portion 22. According to this arrangement, by having the projection 21*a* engage with the front end portion 22*a* when the sheet cassette 21 is inserted to the apparatus body 10, the conveyance guide portion 22 is moved to the mounted position 22A. In other words, the conveyance guide portion 22 has a front end portion 22*a* which is pressed by the projection 21*a* along with the operation of inserting the sheet cassette 21 to the apparatus body 10, causing the conveyance guide portion 22 to move toward the mounted position 22A. Further, the conveyance guide portion 22 is positioned at the mounted position 22A by the projection 21*a* being in contact with and pressing the front end portion 22*a* in the inserting direction when the sheet cassette 21 is attached to the apparatus body 10.

In the present embodiment, the apparatus body 10 of the image forming apparatus 1 also functions as the apparatus body 10 of the sheet feeding portion 20. Therefore, the sheet feeding portion 20 is equipped with the apparatus body 10, the sheet cassette 21, the conveyance guide portion 22 and the projection 21*a*. Of course, the configuration of the interlocking portion is not restricted to the configuration having the projection 21*a* and the front end portion 22*a*.

The apparatus body 10 is equipped with support plates (guide portions) 70 and 80 arranged on left and right sides along the front-rear direction. The respective support plates 70 and 80 guide the guide projections 61 through 64 of the conveyance guide portion 22 in the front and rear directions. The support plate 70 is equipped with a horizontal guide groove 73 formed at an inner side thereof. Guide projections 61 and 62 disposed at the left side of the conveyance guide portion 22 can be engaged with the guide groove 73. Further, the support plate 80 is equipped with a horizontal guide groove 83 formed at an inner side thereof. Guide projections 63 and 64 disposed at the right side of the conveyance guide portion 22 can be engaged with the guide groove 83. Therefore, by having the guide projections 61 and 62 engage with the guide groove 73 and the guide projections 63 and 64 engage with the guide groove 83, the guide plate 60 can slide in the front and rear direction with respect to the respective support plates 70 and 80. Further, the conveyance guide portion 22 can be removed from the apparatus body 10 by pulling out the guide plate 60 from the support plates 70 and 80.

A positioning portion (first positioning portion) 74 is disposed at a rear section of the guide groove 73 on the support plate 70. Further, a positioning portion (second positioning portion) 84 is disposed at a rear section of the guide groove 83 on the support plate 80. In other words, the apparatus body 10 has positioning portions 74 and 84 capable of positioning the conveyance guide portion 22 at the mounted position 22A. In the present embodiment, the positioning portions 74 and 84 are arranged at both sides in a width direction W orthogonal to the direction of insertion and removal of the conveyance guide portion 22 in the apparatus body 10. In other words, the sheet feeding portion 20 has the positioning portion 74, and the positioning portion 84 arranged at an opposite side from the positioning portion 74 with respect to the width direction W of the apparatus body 10.

The positioning portions 74 and 84 include a cam (positioning member) 71 and 81, and a biasing spring (biasing member) 72 and 82, respectively. The respective cams 71 and 81 are arranged rotatably on the respective guide grooves 73 and 83 so as to position the conveyance guide portion 22 at the mounted position 22A, and the cams 71 and 81 are biased to one side in the direction of rotation via the biasing springs 72 and 82. The biasing springs 72 and 82 are formed of compression coil springs, for example, and the springs provide biasing force so that the respective cams 71 and 81 position the conveyance guide portion 22 at the mounted position 22A. The respective cams 71 and 81 move the guide projections 62 and 64 of the conveyance guide portion 22 positioned close to the mounted position 22A to the side of the mounted position 22A via the biasing force of the biasing springs 72 and 82. Thereby, the respective cams 71 and 81 move and position the conveyance guide portion 22 to the mounted position 22A. In the present embodiment, biasing springs 72 and 82 are adopted as biasing members, but the biasing members are not restricted to biasing springs, and for example, the respective cams 71 and 81 can be formed of an elastic member such as rubber that biases the conveyance guide portion 22 to be positioned at the mounted position 22A.

Now, for example, the configuration and operation of the cam 71 and the biasing spring 72 will be described with reference to FIGS. 4A through 4H. The cam 71 and the biasing spring 72 are described here, but the same description applies for the cam 81 and the biasing spring 82.

The cam 71 has a first inclined surface 71*a*, a second inclined surface 71*b*, and a center axis of rotation 71*c*. The first inclined surface 71*a* is directed toward the lower forward F direction, and the second inclined surface 71*b* continuous from the first inclined surface 71*a* is directed toward the lower rearward R direction. A summit (ridge) 71*d* exists between the first inclined surface 71*a* and the second inclined surface 71*b*. The biasing spring 72 biases the cam 71 toward the direction in which the summit 71*d* is rotated downward.

Figure 4A:
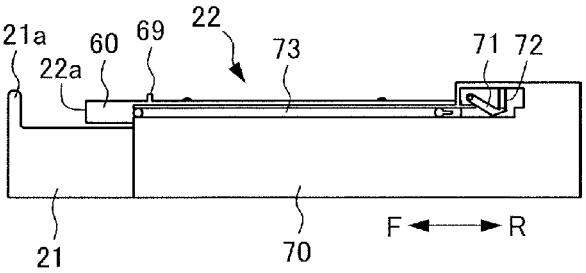
FIG. 4A is a side view of the sheet feeding portion in a state where the sheet cassette and a conveyance guide portion are pulled out of the apparatus body in the image forming apparatus according to the preferred embodiment.
Figure 4B:
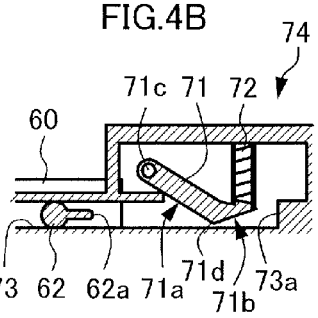
FIG. 4B is an enlarge view of a rear portion of a guide groove of FIG. 4A.
Figure 4C:
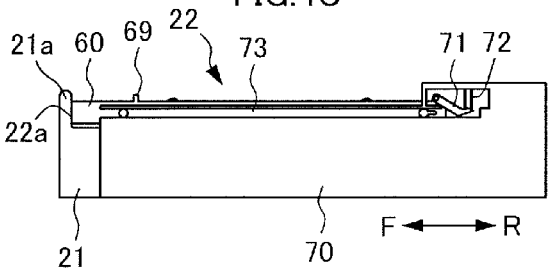
FIG. 4C is a side view of the sheet feeding portion in a state where the sheet cassette is slightly inserted and the conveyance guide portion is positioned close to a mounted position in the image forming apparatus according to the preferred embodiment.
Figure 4D:
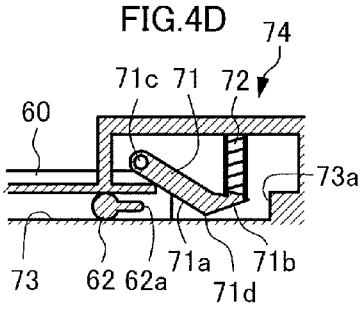
FIG. 4D is an enlarge view of a rear portion of the guide groove of FIG. 4C.

As shown in FIGS. 4A and 4B, when the conveyance guide portion 22 is only half-inserted to the apparatus body 10 and is distant from the mounted position 22A, the guide projection 62 is distant from the cam 71. As shown in FIGS. 4C and 4D, when the sheet cassette 21 is moved toward the insertion direction with respect to the apparatus body 10 by the user, the projection 21*a* contacts the front end portion 22*a* of the conveyance guide portion 22, and the conveyance guide portion 22 is pushed rearward R. Incidentally, the projection 21*a* as the engagement portion of the sheet cassette 21 can be arranged at a position other than the front end portion, and the front end portion 22*a* as the engaged portion of the conveyance guide portion 22 can also be arranged at a position other than the front end portion.

Figure 4E:
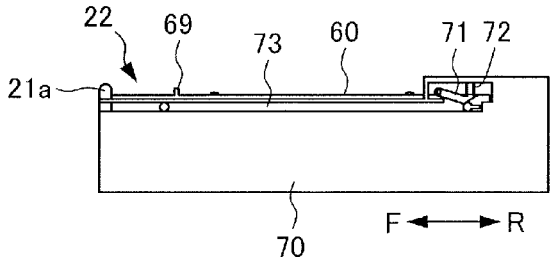
FIG. 4E is a side view of the sheet feeding portion in a state where the sheet cassette is inserted completely in the image forming apparatus according to the preferred embodiment.
Figure 4F:
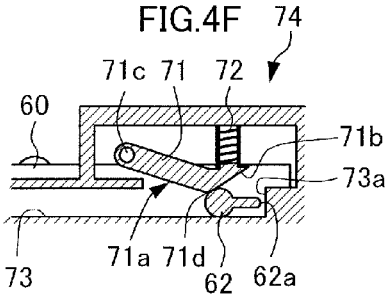
FIG. 4F is an enlarged view of a rear portion of the guide groove of FIG. 4E.

As shown in FIGS. 4E and 4F, accompanying the further insertion of the sheet cassette 21, the guide projection 62 contacts the first inclined surface 71*a* of the cam 71, and rotates the cam 71 opposing to the biasing spring 72. When the guide projection 62 moves beyond the summit 71*d* of the cam 71, the sheet cassette 21 reaches the mounted position, and the pressure applied to the conveyance guide portion 22 is stopped. At this time, the guide projection 62 contacts the second inclined surface 71*b* of the cam 71.

Figure 4G:
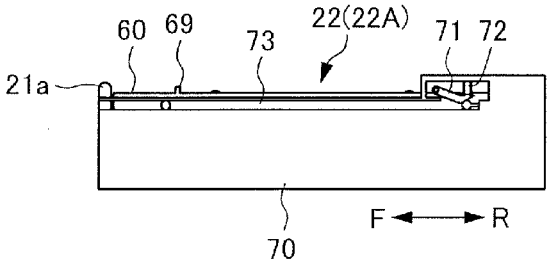
FIG. 4G is a side view of the sheet feeding portion in a state where a positioning portion is activated in the image forming apparatus according to the preferred embodiment.
Figure 4H:
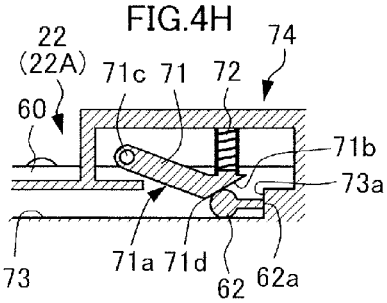
FIG. 4H is an enlarged view of a rear portion of the guide groove of FIG. 4G.

As shown in FIGS. 4G and 4H, the guide projection 62 contacts the second inclined surface 71*b* of the cam 71, and the second inclined surface 71*b* biases the guide projection 62 rearward R by the biasing force of the biasing spring 72. Thereby, the conveyance guide portion 22 is pressed rearward R, and a rear end surface 62*a* of the guide projection 62 contacts a rear end surface 73*a* of the guide groove 73. The position of the conveyance guide portion 22 when the rear end surface 62*a* of the guide projection 62 contacts the rear end surface 73*a* of the guide groove 73 is the mounted position 22A. At this time, the position of the guide projection 62 is determined with respect to the support plate 70, so that the positions of the driven rollers 65 and 66 are stabilized. Thereby, the driven rollers 65 and 66 are pressed against the drive rollers 90 and 91 of the apparatus body 10 at appropriate positions in a stable manner, so that it becomes possible to suppress the occurrence of slipping and skewing when manually feeding the manually-fed sheet Sa.

Further, by the engagement of the cam 71 and the guide projection 62, the tolerance of components from the front end portion 22*a* of the conveyance guide portion 22 to the rear end surface 62*a* and the tolerance of components from the projection 21*a* to the rear end surface 73*a* can be absorbed. Thereby, it becomes possible to determine the position of the conveyance guide portion 22 with respect to the apparatus body 10 in a state where the conveyance guide portion 22 is biased by the biasing spring 72 to the apparatus body 10.

Further, when the drive rollers 90 and 91 are rotated, a rearward R force is transmitted to the driven rollers 65 and 66. By having this force transmitted to the conveyance guide portion 22 at the contact portion of the conveyance guide portion 22 with the driven rollers 65 and 66, the positioning of the conveyance guide portion 22 with respect to the apparatus body 10 is further stabilized. Thus, it becomes possible to suppress the displacement of the driven rollers 65 and 66 in the front-rear directions with respect to the drive rollers 90 and 91, and to suppress slipping during conveyance of the sheets. In the present embodiment, the positioning portions 74 and 84 are arranged at both sides in the width direction W of the apparatus body 10. Therefore, it becomes possible to suppress the rotation of the conveyance guide portion 22 around the Z axis, and to suppress skewing caused by the displacement of the driven rollers 65 and 66.

For example, the pressing force toward the forward F direction occurring by the driven rollers 65 and 66 being pressed by the biasing springs 72 and 82 toward the drive rollers 90 and 91 is defined as f1. Further, based on the own weight of the conveyance guide portion 22, the frictional force between the guide projections 61 through 64 and the guide grooves 73 and 83 is defined as f2, and the force in the attaching-detaching direction via the frictional force at the center of rotation of the cams 71 and 81 is defined as f3. In this case, the biasing force of the biasing spring 72 is set so that a drawing force f0 greater than f1+f2+f3 can be generated when the guide projection 62 of the conveyance guide portion 22 moves beyond the summit 71*d* of the cam 71. Thereby, the conveyance guide portion 22 is moved rearward R from the position shown in FIGS. 4E and 4F where the guide projection 62 has just passed the summit 71*d* of the cam 71 to the position shown in FIGS. 4G and 4H where the rear end surface 62*a* contacts the rear end surface 73*a*. Thereby, the positioning performance of the conveyance guide portion 22 with respect to the apparatus body 10 can be improved.

Next, we will describe the sheet presence detecting portion 100 in the above-described image forming apparatus 1 in detail with reference to FIGS. 5 through 10.

Figure 5:
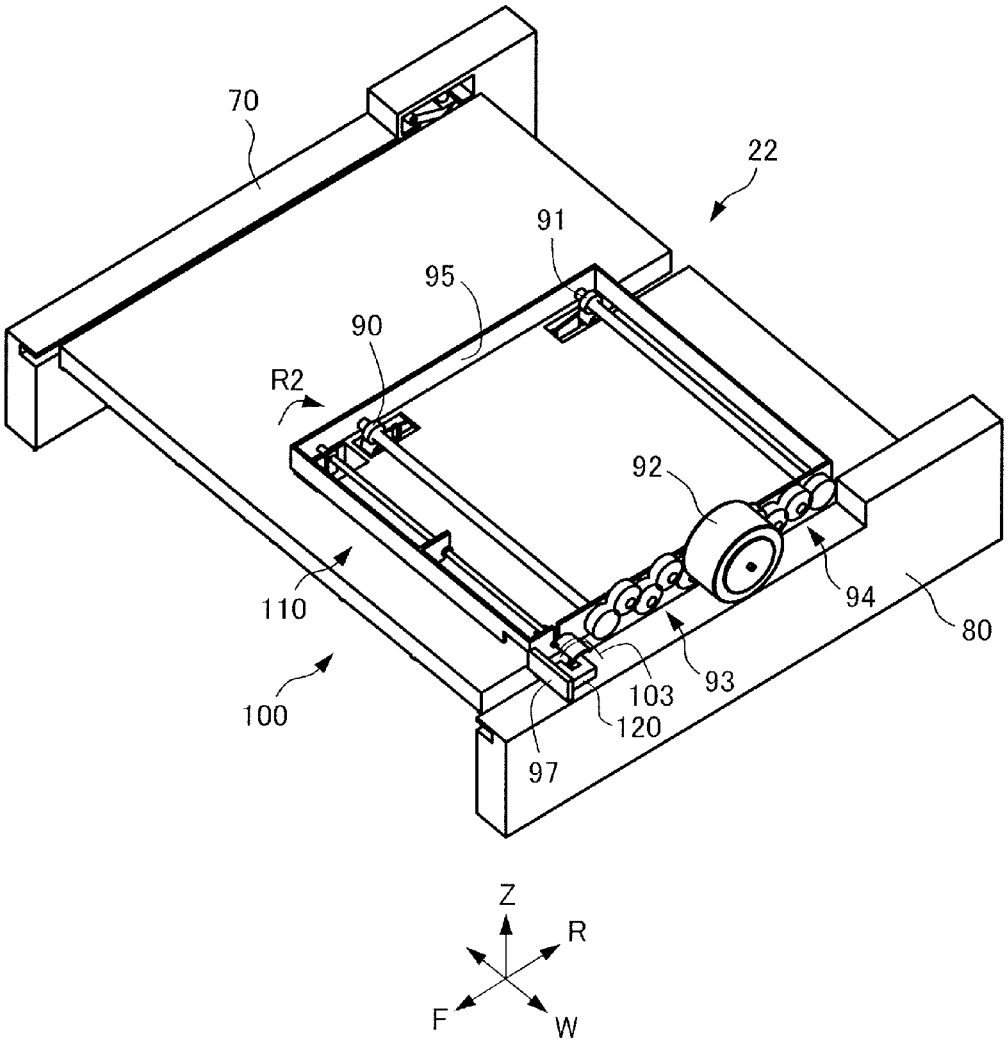
FIG. 5 is a schematic diagram illustrating an upper portion of the sheet feeding portion of the image forming apparatus according to the preferred embodiment.

As shown in FIG. 5, the sheet presence detecting portion 100 is equipped with a detection member 110 capable of being rotated by the insertion of the manually-fed sheet Sa, a sensor (detection portion) 120 capable of detecting the rotation of the detection member 110, and a biasing spring 103 for biasing the detection member 110.

Figure 6:
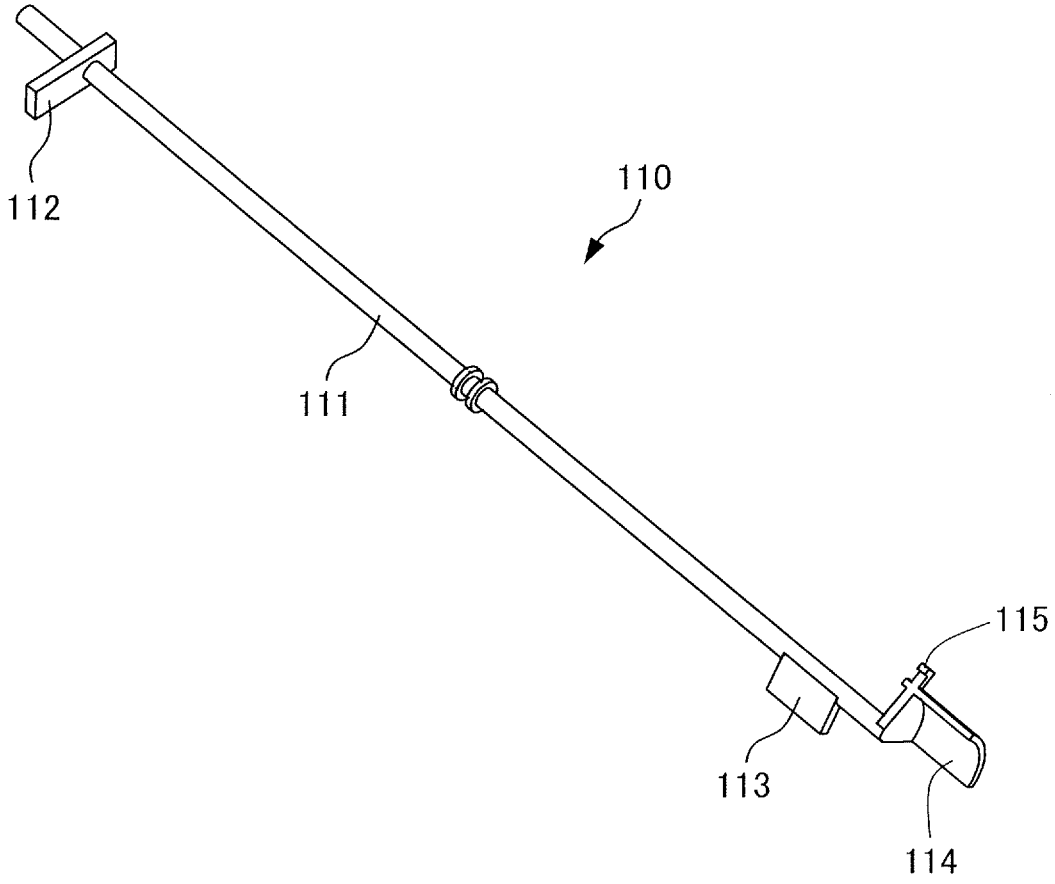
FIG. 6 is a schematic diagram showing a detection member according to the preferred embodiment.

As shown in FIG. 6, the detection member 110 is integrally formed of a shaft 111, a flag (moving member) 112, a projection 113, a light shielding plate 114, and an engaging claw 115. In other words, the flag 112, the projection 113, the light shielding plate 114 and the engaging claw 115 are rotated integrally when the detection member 110 rotates around the shaft 111.

As shown in FIGS. 5 and 6, the shaft 111 is supported rotatably by the supporting portion 95, and is arranged so that the width direction W is arranged in the longitudinal direction. The flag 112 is retractable with respect to the sheet conveyance path R1 along with the rotation of the shaft 111. That is, the flag 112 is capable of moving between a first position (refer to FIG. 8B) where the flag protrudes downward and blocks the sheet conveyance path R1 and a second position (refer to FIG. 9B) where the flag is pushed up by the manually-fed sheet Sa conveyed through the sheet conveyance path R1.

Figure 8A:
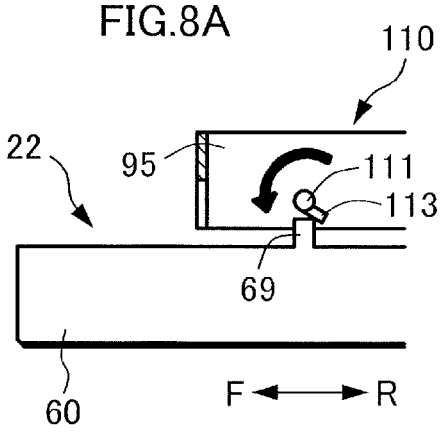
FIG. 8A is a side view showing a relationship between the projection of the detection member and the engagement projection of the conveyance guide portion, in a state where the conveyance guide portion of the sheet feeding portion is at the mounted position and there is no sheet on the sheet conveyance path in the image forming apparatus according to the preferred embodiment.

The projection 113 rotates the shaft 111 by having the engagement projection 69 of the conveyance guide portion 22 engaged (refer to FIG. 8A). The light shielding plate 114 turns the sensor 120 on and off by passing the sensor 120 via the rotation of the shaft 111. The engaging claw 115 has one end of the biasing spring 103 engaged thereto.

Figure 7A:
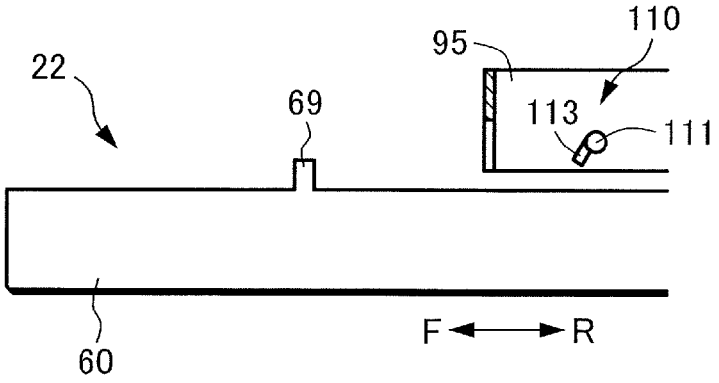
FIG. 7A is a side view showing a relationship between a projection of the detection member and an engagement projection of the conveyance guide portion, in a state where the conveyance guide portion of the sheet feeding portion is pulled out from the mounted position in the image forming apparatus according to the preferred embodiment.
Figure 7B:
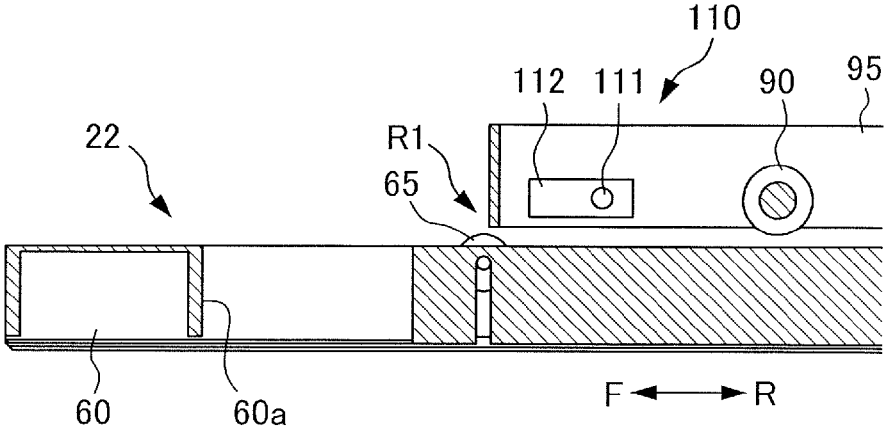
FIG. 7B is a side view showing a relationship between a flag of the detection member and the sheet conveyance path, in a state where the conveyance guide portion of the sheet feeding portion is pulled out from the mounted position in the image forming apparatus according to the preferred embodiment.
Figure 7C:
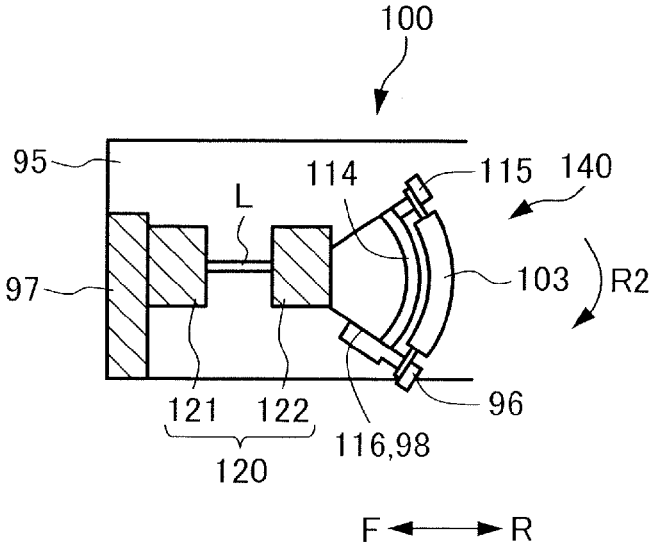
FIG. 7C is a side view showing a sheet presence detecting portion and an evacuation mechanism, in a state where the conveyance guide portion of the sheet feeding portion is pulled out from the mounted position in the image forming apparatus according to the preferred embodiment.

The sensor 120 is connected to the control unit 2, and for example, it can be an optical sensor having a light emitting component 121 and a photosensing component 122 (refer to FIG. 7C). The sensor 120 outputs the switching of on/off of the sensor as detection signal, based on whether a light beam L irradiated from the light emitting component 121 is received by the photosensing component 122 or not. In other words, the on/off of the photosensing component 122 is switched in the sensor 120 by the light shielding plate 114 passing the area between the light emitting component 121 and the photosensing component 122. The sensor 120 can detect whether the flag 112 is positioned at the first position or the second position based on the on/off state of the photosensing component 122. The sensor 120 can detect whether the manually-fed sheet Sa is in the sheet conveyance path R1 or not by detecting the rotation angle of the detection member 110 based on the position of the flag 112.

The sensor 120 is fixed to a support plate 97 fixed to the supporting portion 95. In the present embodiment, an optical sensor is adopted as the sensor 120, but the sensor is not restricted to an optical sensor, as long as the configuration enables to detect the rotation of the flag 112. For example, a switch that can be switched between on and off based on the amount of rotation of the detection member 110 can be utilized.

The biasing spring 103 is composed of a helical extension spring, having one end engaged to the engaging claw 115 of the detection member 110 and the other end engaged to an engaging claw 96 of the supporting portion 95 (refer to FIG. 7C). Thereby, the biasing spring 103 biases the detection member 110 in a direction of rotation R2.

Further, the sheet presence detecting portion 100 has an evacuation mechanism 140 for evacuating the flag 112 to an area above the sheet conveyance path R1 when the conveyance guide portion 22 is not at the mounted position 22A (refer to FIG. 7B). In the present embodiment, the evacuation mechanism 140 is composed of the shaft 111, the engaging claw 115 and the biasing spring 103.

Now, we will describe the operation of the sheet presence detecting portion 100 with reference to FIGS. 7A through 10.

FIGS. 7A through 7C illustrate a state where the conveyance guide portion 22 is separated from the mounted position 22A. At this time, the engagement projection 69 of the conveyance guide portion 22 is separated from the projection 113. Therefore, the engaging claw 115 is pulled by the biasing spring 103 toward the engaging claw 96 in the direction of rotation R2, so that an end surface 116 of the light shielding plate 114 and an end surface 98 of the engaging claw 96 contact one another. The flag 112 is retained in a state being evacuated from the sheet conveyance path R1 via the evacuation mechanism 140. The light shielding plate 114 will not block the light beam L of the sensor 120, so that the sensor detects that there is no manually-fed sheet Sa.

Figure 8B:
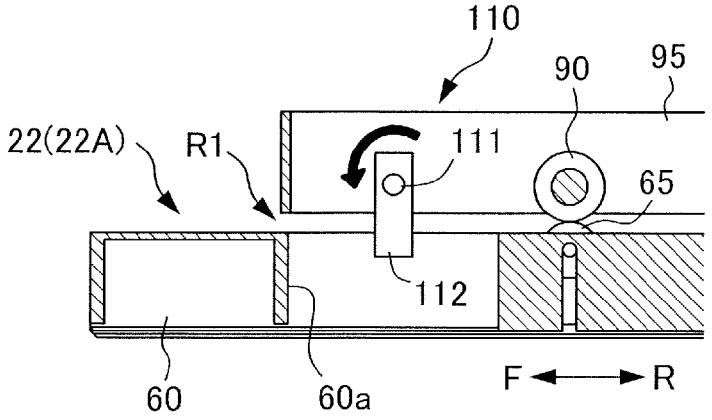
FIG. 8B is a side view showing a relationship between the flag of the detection member and the sheet conveyance path, in a state where the conveyance guide portion of the sheet feeding portion is at the mounted position and there is no sheet on the sheet conveyance path in the image forming apparatus according to the preferred embodiment.
Figure 8C:
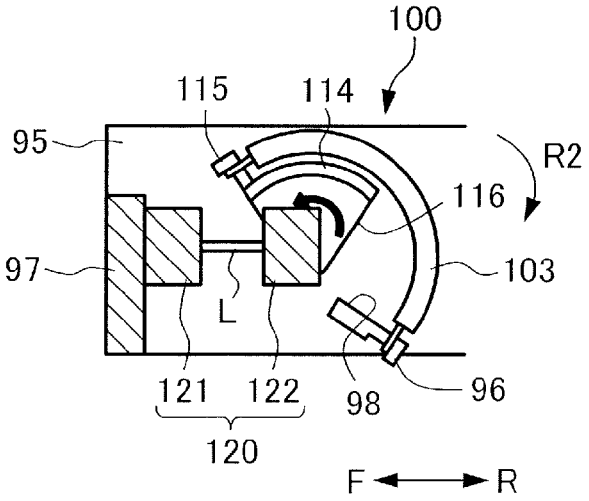
FIG. 8C is a side view showing a sheet presence detecting portion and the evacuation mechanism, in a state where the conveyance guide portion of the sheet feeding portion is at the mounted position and there is no sheet on the sheet conveyance path in the image forming apparatus according to the preferred embodiment.

Next, FIGS. 8A through 8C illustrate a state where the conveyance guide portion 22 is positioned at the mounted position 22A and there is no manually-fed sheet Sa. At this time, the engagement projection 69 of the conveyance guide portion 22 contacts the projection 113, and rotates the shaft 111 for approximately 90 degrees to an opposite direction from the direction of rotation R2, opposing to the biasing spring 103. Therefore, the biasing spring 103 is expanded by the rotation of the engaging claw 115. The flag 112 is retained in a protruded state in the sheet conveyance path R1 by rotation. The light shielding plate 114 will not block the light beam L of the sensor 120, so that the sensor senses that there is no manually-fed sheet Sa.

Figure 9A:
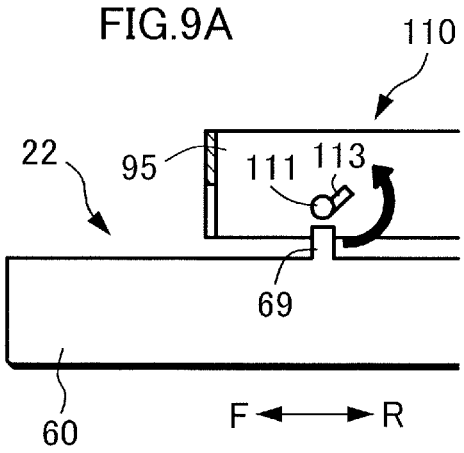
FIG. 9A is a side view showing a relationship between the projection of the detection member and the engagement projection of the conveyance guide portion, in a state where the conveyance guide portion of the sheet feeding portion is at the mounted position and a sheet exists on the sheet conveyance path in the image forming apparatus according to the preferred embodiment.
Figure 9B:
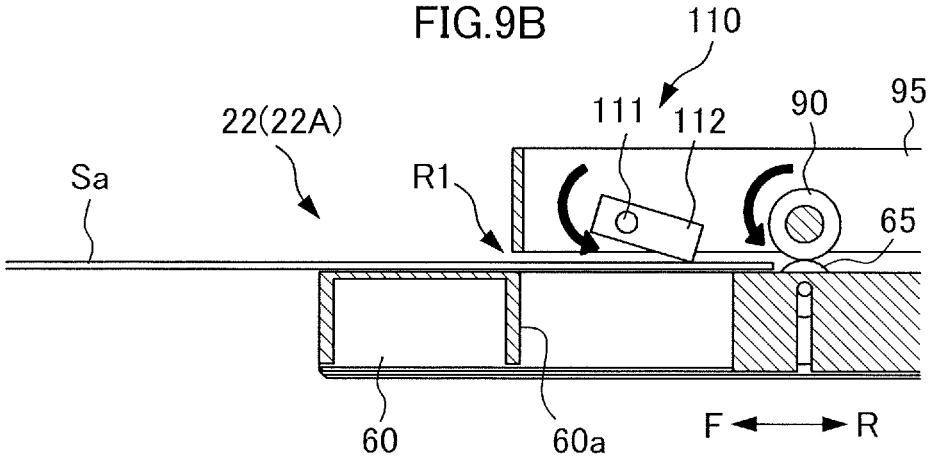
FIG. 9B is a side view showing a relationship between the flag of the detection member and the sheet conveyance path, in a state where the conveyance guide portion of the sheet feeding portion is at the mounted position and a sheet exists in the sheet conveyance path in the image forming apparatus according to the preferred embodiment.
Figure 9C:
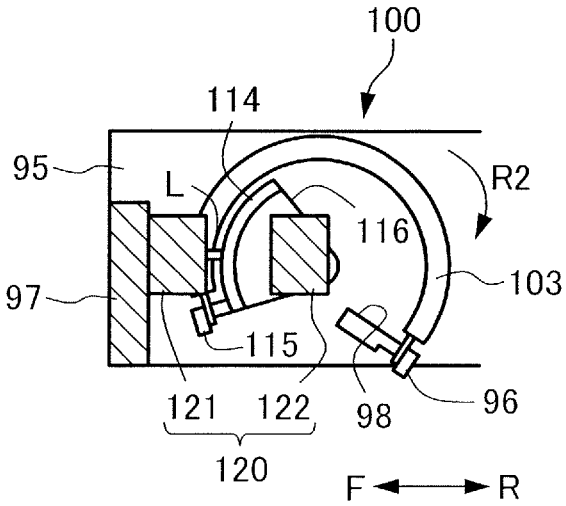
FIG. 9C is a side view showing the sheet presence detecting portion and the evacuation mechanism, in a state where the conveyance guide portion of the sheet feeding portion is at the mounted position and a sheet exists in the sheet conveyance path in the image forming apparatus according to the preferred embodiment.

Next, FIGS. 9A through 9C illustrate a state where the conveyance guide portion 22 is positioned at the mounted position 22A and the manually-fed sheet Sa is inserted. At this time, the manually-fed sheet Sa presses the flag 112 toward the rearward direction R, and the flag 112 rotates the shaft 111 for approximately 70 degrees to the opposite direction from the direction of rotation R2, opposing to the biasing spring 103. The projection 113 is separated from the engagement projection 69 of the conveyance guide portion 22. The biasing spring 103 is further expanded by the rotation of the engaging claw 115. The light shielding plate 114 shields the light beam L of the sensor 120, preventing the light beam L from being received by the photosensing component 122, so that the sensor 120 detects the presence of the manually-fed sheet Sa.

Figure 10:
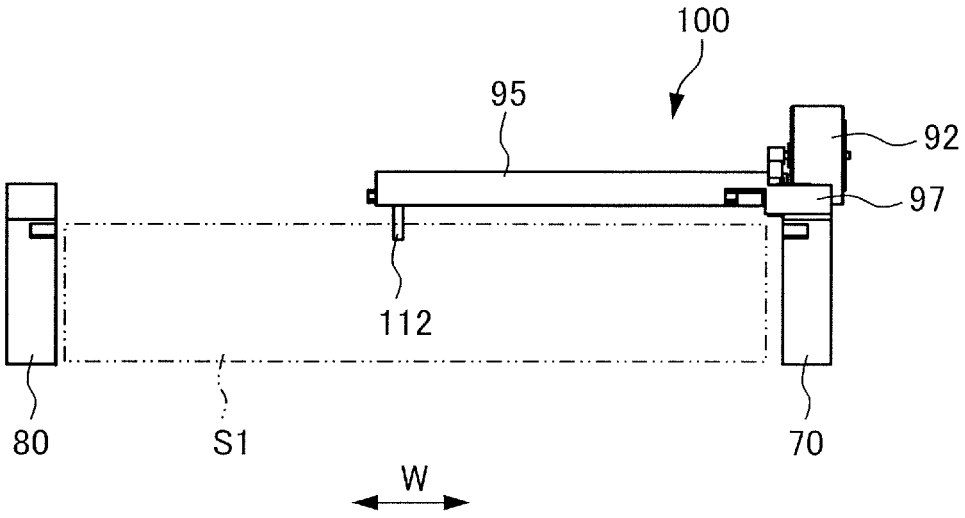
FIG. 10 is a schematic diagram showing a state of a flag of the sheet feeding portion in an image forming apparatus according to a prior art.

Incidentally, when the manually-fed sheet Sa is jammed within the sheet conveyance path R1, the sheet cassette 21 and the conveyance guide portion 22 can be removed from the apparatus body 10 to form a jam handling space S1 below the sheet conveyance path R1, as shown in FIG. 10. Thereby, it becomes possible to cope with the jamming of the manually-fed sheet Sa. Now, if the sheet presence detecting portion 100 does not have an evacuation mechanism 140, the flag 112 will remain protruded in the jam handling space S1 below the sheet conveyance path R1, as shown in FIG. 10. When the jamming is handled in this state, an unexpected external force may be applied to the flag 112, and the flag 112 may be damaged.

On the other hand, according to the image forming apparatus 1 of the present embodiment, the sheet presence detecting portion 100 is equipped with the evacuation mechanism 140. Therefore, when the conveyance guide portion 22 is removed from the apparatus body 10, the flag 112 will be moved and retained at the upper area, so that the possibility of the flag 112 being damaged while handling the jammed sheet in the jam handling space S1 can be reduced greatly.

As described, according to the image forming apparatus 1 of the present embodiment, the projection 21*a* causes the conveyance guide portion 22 to be positioned at the mounted position 22A along with the operation of inserting the sheet cassette 21 to the apparatus body 10. Thereby, even by having a conveyance guide portion 22 capable of being inserted to and removed from the apparatus body 10, the slipping and skewing of the manually-fed sheet Sa when feeding the manually-fed sheet Sa via the conveyance guide portion 22 can be suppressed.

According further to the image forming apparatus 1 of the present embodiment, the apparatus body 10 is equipped with positioning portions 74 and 84. Therefore, the inserted conveyance guide portion 22 being pressed rearward R by the projection 21*a* can be positioned and retained securely at the mounted position 22A, regardless of the dimensional errors and assembly errors of the components.

According further to the image forming apparatus 1 of the present embodiment, the sheet presence detecting portion 100 is equipped with the evacuation mechanism 140 of the flag 112. According to the mechanism, the flag 112 will be retained in the upper area when the conveyance guide portion 22 is removed from the apparatus body 10, so that the possibility of the flag 112 being damaged during handling of the jammed sheet in the jam handling space S1 can be reduced significantly.

In the present embodiment described above, cams 71 and 81 and biasing springs 72 and 82 that engage with the guide projections 62 and 64 of the conveyance guide portion 22 are provided as positioning portions 74 and 84, but the present embodiment is not restricted to this configuration. For example, it is also possible to provide a drawing mechanism for drawing the sheet cassette 21 rearward R to the apparatus body 10. In that case, the drawing action of the sheet cassette 21 via the drawing mechanism causes the conveyance guide portion 22 to move rearward R, and the conveyance guide portion is sandwiched and supported by the sheet cassette 21 and the apparatus body 10 in a spring-biased manner. Even according to such configuration, the conveyance guide portion 22 can be positioned at the mounted position 22A along with the operation of inserting the sheet cassette 21 to the apparatus body 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234446, filed Nov. 19, 2014 which is hereby incorporated by reference herein in its entirety.

What is claimed is:

1. A sheet conveyance apparatus comprising:

an apparatus body;

a sheet stacking portion on which sheets are stacked, the sheet stacking portion including an engagement portion and provided to be insertable to and removable from the apparatus body; and a conveyance guide portion provided to be insertable to and removable from the apparatus body and constituting a sheet conveyance path through which a sheet passes in a state where the conveyance guide portion is mounted to a mounted position in the apparatus body, the conveyance guide portion including an engaged portion that is pressed by the engagement portion accompanying an operation where the sheet stacking portion is inserted to the apparatus body, and moves the conveyance guide portion to the mounted position, wherein the apparatus body has a positioning portion positioning the conveyance guide portion at the mounted position, wherein the positioning portion has a positioning member positioning the conveyance guide portion at the mounted position and a biasing member biasing the positioning member to position the conveyance guide portion at the mounted position, wherein the conveyance guide portion has a projection protruding at least to one side in a width direction orthogonal to an insertion and removal direction, wherein the positioning member positions the conveyance guide portion to the mounted position by positioning the projection by the biasing force of the biasing member, wherein the apparatus body has a guide portion guiding the projection of the conveyance guide portion to the insertion and removal direction.

2. The sheet conveyance apparatus according to claim 1, wherein the conveyance guide portion is arranged above the sheet stacking portion, and when the sheet stacking portion is mounted to the apparatus body, the conveyance guide portion is positioned at the mounted position by the engagement portion being in contact with the engaged portion and pressing the engaged portion in an inserting direction.

3. The sheet conveyance apparatus according to claim 1, wherein the engagement portion is arranged to protrude upward in a downstream end portion in a removal direction of the sheet stacking portion; and the engaged portion is disposed at a downstream edge portion in the removal direction of the conveyance guide portion.

4. The sheet conveyance apparatus according to claim 1, further comprising a second positioning portion arranged at an opposite side from a first positioning portion being said positioning portion with respect to a width direction orthogonal to an insertion and removal direction of the conveyance guide portion in the apparatus body.

5. The sheet conveyance apparatus according to claim 1, wherein when the conveyance guide portion is positioned adjacent to the mounted position, the positioning member moves the projection of the conveyance guide portion by the biasing force of the biasing member so as to move the conveyance guide portion to the mounted position.

6. The sheet conveyance apparatus according to claim 1, further comprising a sheet presence detecting portion including a moving member disposed above the conveyance guide portion, and capable of moving from a first position protruding downward and blocking the sheet conveyance path to a second position being pushed up by a sheet conveyed through the sheet conveyance path, and a detection portion capable of detecting whether the moving member is positioned at the first position or the second position.

7. The sheet conveyance apparatus according to claim 6, wherein the sheet presence detecting portion has an evacuation mechanism capable of evacuating the moving member above the sheet conveyance path when the conveyance guide portion is not at the mounted position.

8. The sheet conveyance apparatus according to claim 1, wherein the apparatus body has a manual feed port capable of feeding a manually-fed sheet inserted from an exterior of the apparatus body to the sheet conveyance path.

9. The sheet conveyance apparatus according to claim 1, further comprising:

a drive roller disposed on the apparatus body;

wherein the conveyance guide portion has a driven roller driven by the drive roller and conveying a sheet.

10. An image forming apparatus comprising:

an image forming portion forming an image; and the sheet conveyance apparatus according to claim 1 capable of feeding a sheet to the image forming portion.

* * * * *